US005330635A

United States Patent [19]

Floyd, Jr.

[11] Patent Number: 5,330,635

[45] Date of Patent: Jul. 19, 1994

[54] PROTECTIVE COATING PROCESS FOR ALUMINUM AND ALUMINUM ALLOYS

[75] Inventor: Robert L. Floyd, Jr., Norcross, Ga.

[73] Assignee: Lockheed Corporation, Calabasas, Calif.

[21] Appl. No.: 36,765

[22] Filed: Mar. 25, 1993

[51] Int. Cl.[5] ..... C25D 5/00

[52] U.S. Cl. ..... 205/204; 205/203

[58] Field of Search ..... 205/200, 201, 204, 224, 205/203

[56] References Cited

U.S. PATENT DOCUMENTS

| | | | |
|---|---|---|---|
| 3,775,266 | 11/1973 | Ikeda et al. | 205/201 |
| 3,799,848 | 3/1974 | Kolic et al. | 205/201 |
| 4,310,390 | 1/1982 | Bradley et al. | 205/204 |
| 4,515,919 | 5/1985 | Bradley et al. | 205/201 |
| 4,897,231 | 1/1990 | Scheurer et al. | 205/201 |
| 5,104,514 | 4/1992 | Quartarone | 205/201 |

*Primary Examiner*—John Niebling
*Assistant Examiner*—Kishor Mayekar
*Attorney, Agent, or Firm*—Eric R. Katz

[57] ABSTRACT

A protective coating process is described for simultaneously sealing and priming the anodic coating applied to a metal compound without the need for elevated temperatures during a subsequent curing step. The process comprises the steps of anodizing the component to be coated, applying the coating composition at an elevated temperature of about 150 degrees F. to thereby simultaneously seal and prime the component and curing the sealed and primed component at ambient temperatures. If cross-linking agents are employed then elevated cure temperatures are utilized.

2 Claims, No Drawings

PROTECTIVE COATING PROCESS FOR ALUMINUM AND ALUMINUM ALLOYS

TECHNICAL FIELD

The present invention generally relates to an improved protective coating process for providing corrosion protection for metals, and more particularly, to a process for simultaneously sealing and priming the anodic coating such as those applied to metals of the same periodic table group as aluminum and alloys thereof that is relatively non-polluting since little, if any, organic volatile material need be present in the coating composition.

BACKGROUND ART

Known processes for applying corrosion resistant protective coatings on aluminum substrates are typically sequential in nature and utilize a chemical or electro-chemical surface treatment followed by the application of an organic primer. The aluminum substrate or component is first anodized, then sealed through hydration and subsequently the sealed anodic coating is coated, typically with an organic primer.

The multiple separate and distinct process steps of the above-noted coating operation result in a build-up of layers which creates dimensional problems due to the film thicknesses of the anodic coating and the primer. This build-up of layers results in an ultimate coating having a durability which is critically dependent on the degree of chemical/mechanical bonding between layers. Moreover, the entire operation for producing the multi-layered coating requires an appreciable amount of time and labor.

In an attempt to overcome the shortcomings of the known coating processes, the inventors of the present invention disclosed in Bradley et al. (4,310,390), assigned to the assignee of the present application, a protective coating process which reduces the number of process steps required to form a protective coating. The reduction of process steps is achieved by introducing a water-borne, water soluble acrylic resin into the sealing step of an otherwise conventional anodizing sequence to thereby simultaneously seal and impregnate the anodic coating. Subsequent to the sealing step, however, the resultant coating is cured at elevated temperatures up to 500° F. The requirement of a heating step is not only costly in terms of production time and energy, but requires the maintenance of a precisely controlled temperature/time range which is difficult to achieve.

An improved coating composition and a simplified process to produce a protective coating for providing corrosion protection for metals is also disclosed by U.S. Pat. No. 4,515,919 to Bradley et al., assigned to the assignee of the present application, wherein an anodic coating applied to aluminum and alloys thereof is simultaneously sealed and impregnated at temperatures in excess of about 170° F., in a time/temperature relationship, the coating being cured without the need for elevated cure temperatures. Although the coating is operationally quite efficient, the protective coating process of the '919 patent requires complex and expensive facilization in order to prevent accelerated solution aging and polymerization skinning of the resin when scaled up from a pilot line configuration to a production scale.

DISCLOSURE OF THE INVENTION

It is, therefore, an object of the present invention to provide an improved coating process for producing a protective coating to provide corrosion protection for metals using the protective coating composition (resin) disclosed by U.S. Pat. No. 4,515,919 to Bradley et al. wherein the possibility of accelerated solution aging and polymerization skinning of the resin are eliminated when the process is scaled up from a pilot line configuration to a production scale.

One particularly advantageous and unobvious feature of the process of the present invention is the discovery that, if the minimum processing temperature of 170° F. required by the process of the '919 patent is reduced to 150° F., and the useful lifetime of the resin bath is substantially increased over that of the '919 patent by elimination of the accelerated solution aging and polymerization skinning of the resin bath while assuring that adequate hydration of the anodized component is still provided in order to seal the component and protect against corrosion.

A further advantage of the present invention is that it is relatively non-polluting since little, if any, organic volatile material need be present in the coating composition.

Yet another advantage of the present invention is that it provides a protective coating having improved stability at elevated temperature.

Still a further advantage of the present invention is that it provides a protective coating having the ability to easily accept topcoats.

Another advantage of the present invention is the option to eliminate of heat curing after sealing, thus further reducing the cost of production.

The process of the present invention is patentably distinguished over that of the '919 patent by unexpected discovery of the lowering of the minimum processing temperature to about 150° F. whereas in the process of the '919 patent it was thought that a temperature of at least 170° F. would be required in order to adequately hydrate the anodic coating. However, after extensive experimentation, the inventor of the present invention discovered that a processing temperature of only approximately 150° F. would result in sufficient hydration of the anodic coating to effect sealing of the anodic coating while dramatically improving the useful life of the resin bath by eliminating the possibility of accelerated resin bath aging and polymerization skinning. Hydration of the anodic coating is particularly important when the component is made of aluminum or aluminum alloys in order to make the anodic coating resistance to corrosion by sealing the coating when the hydration swells up and seals the coating against infusion of corrosion creating elements.

In accordance with these and other advantages, objects and features of the present invention, there is provided an improved protective coating process for metal components capable of being anodized, such as those of the same periodic group as aluminum and alloys thereof, the process comprising the steps of: 1) anodizing a metal component to be coated to provide an anodized component; 2) applying a coating composition comprising a colloidal, water dispersible urethane elastomer resin, such as a polyurethane resin, to the anodized component at a temperature of approximately 150° F. for a period ranging from about 30 to about 60 minutes, wherein the composition seals the anodized component through hydration and simultaneously primes the anodized component to provide a surface coating capable of being cured at ambient temperatures thereby eliminating the need for elevated temperatures during a subsequent curing step; and 3) curing the surface coating of the sealed and primed component.

According to another embodiment of the process of the present invention, the step of applying the coating composition to the anodized component occurs at a temperature range of approximately 150° F. to less than approximately 170° F. for a period ranging from about 30 to about 60 minutes, the time and temperature being inversely related.

According to yet another embodiment of the process of the present invention, the process further comprises the step of adding a nitrogenous cross-linking (curing) agent during the applying step and subsequently curing the sealed and primed component at an elevated cure temperature.

The protective coating composition employed by the process of the present invention is disclosed by U.S. Pat. No. 4,515,919, the entire disclosure of which is herein incorporated by reference. Prior to application to the anodic coatings, this coating composition is a colloidal, water-borne urethane elastomer such as a polyurethane resin adapted for introduction during the sealing step of a typical anodizing process. The colloidal polyurethane resin, when applied at elevated temperatures to an unsealed anodic coating such as those formed on aluminum and aluminum alloys, simultaneously seals the anodic coating to its monohydrate/trihydrate form and impregnates the sealed anodic coating with the resin. Subsequently, the resin is chemically cured at ambient temperatures thereby eliminating the need for elevated temperatures during curing.

The preferred water dispersible polyurethane resin of this coating composition is an aromatic, aliphatic or alicyclic isocyanide copolymer which may contain certain corrosion inhibitors such as zinc, strontium, calcium, sodium, potassium, and other soluble or insoluble chromates, dichomates, phosphates, tungstates or molybdates including amine complexes of molybdic or tungstic acids and organic titanate complexes.

The polyurethane resin is comprised of various reacted isocyanate prepolymers based on such monomers as 2,4-toluene diisocyanate; 2,6-toluene diisocyanate; 1,4-cyclohexane diisocyanate; dicyclohexylmethane-4,4'-diisocyanate; xylene diisocyanate; 1-isocyanato-3-isocyanatomethyl-3,5,5-trimethyl-cyclohexane, hexamethylene diisocyanate; methylcyclohexyl diisocyanate; 2,4,4-trimethylhexylmethylene diisocyanate and the like.

BEST MODE FOR CARRYING OUT THE INVENTION

In the process of the invention, a colloidal, water-borne resin material, such as polyurethane resin as disclosed by U.S. Pat. No. 4,515,919, is used to convert the unsealed anodic coating to the monohydrate/trihydrate form of aluminum oxide, during the sealing step of an otherwise conventional aluminum anodizing process. The sealed anodic coating will cure an ambient temperatures, however, depending upon the formulation or composition of the sealing bath, may be cured at temperatures of up to about 500° F. This process provides a total protection system that has characteristics superior to separately anodized and organically primed aluminum, obtained through conventional processes.

The protective coating composition used by the process of the present invention comprises an urethane elastomer resin formed from an aromatic, aliphatic or alicyclic isocyanate copolymer dispersed in water. The coating composition may contain such corrosion inhibitors as zinc, strontium, calcium, sodium, potassium and other soluble or insoluble chromates, dichromates, phosphates, tungstates or molybdates including amine complexes of molybdic or tungstic acids and organic titanate complexes.

Preferably the water dispersible urethane elastomer resin is a polyurethane resin which comprises various reacted isocyanate prepolymers based on such monomers as 2,4-toluene diisocyanate; 2,6 toluene diisocyanate; 1,4-cyclohexane diisocyanate; dicyclohexylmethane-4,4'-diisocyanate; xylene diisocyanate; 1-isocyanato-3-isocyanatomethyl-3,5,5-trimethylcyclohexane; hexamethylene diisocyanate; methylcyclohexyl diisocyanate; 2,4,4-trimethyl hexylmethylene diisocyanate and the like. While aromatic diisocyanates can be employed as the diisocyanate component, they are generally less preferred in some applications due to yellowing which results from exposure to ultraviolet light or where hydrolytic stability is important. The aliphatic and alicyclic diisocyanates generally exhibit excellent resistance to the degradative effects of ultraviolet light and therefore these aliphatic and alicyclic diisocyanates are preferred.

It is appreciated that the polyurethane resin is a copolymer and therefore it is desirable to utilize a mixture of the above-noted monomers in order to provide various properties to the ultimate coating composition such as improved corrosion resistance, chip resistance, adherence, gloss, flexibility, durability, hardness, flow and solvent resistance.

The polyurethane resin is any of a variety of various synthetic rubber polymers produced by the polymerization of a hydroxyl radical and an NCO group from two different compounds. The polyurethane resin is based on the aforementioned monomers and comprises, for example, a stable, aqueous colloidal dispersion of urea-urethane polymer salt. The dispersion is infinitely dilutable with water and the polymer salt comprises a tertiary amine salt of urea-urethane polymer prepared by reaction with a carboxylic group containing isocyanate-terminated urethane prepolymer and polyamine. The prepolymer is the reaction product of polyisocyanate and a polyol having sufficient carboxylic groups which are relatively non-reactive with isocyanate to provide the prepolymer with an acid value of about 17 to 60 on an unneutralized basis. The polyisocyanate is selected from the group comprising aromatics, aliphatics or alicyclics and after neutralization with a primary, secondary or tertiary amine provides a stable, aqueous colloidal dispersion.

The preferred amine neutralizer is a triamine having at least two amine groups selected from the group comprising primary amine groups and secondary amine groups reactive with isocyanate groups. The polyamine has on the average of at least 2.2 amine nitrogen atoms having active hydrogen per molecule of polyamine.

The coating composition is, preferably, one having a basic pH in the range of 8 to 9. This pH is adjustable with either nitrogen containing materials or water soluble salts. Due to the processing temperature, high boiling polyamines are preferred.

The colloidal polyurethane resin used by the process of the present invention forms a cured protective coating at room temperature, the coating providing good resistance to water and organic solvents. The coating is relatively non-polluting since little, if any, organic volatile material need be present in the composition. Apparently, when the dispersion is cured as a film, cure occurs due to the use of the triamine-containing solubilizing agent, and the resulting coating have enhanced organic solvent resistance and other desirable properties with respect to hardness, elongation and tear resistance.

Since, at elevated curing temperatures, some of the polyamine groups are detached from the isocyanate chain, effective cross-linking agents can be used to produce even harder, more resistant polymeric films. While a number of cross-linking agents can be employed, aziridine or a substituted melamine is most effective. The disadvantage with aziridine is its transience, particularly at the processing temperatures required. Therefore, the more practical is the substituted melamines and the preferred is hexa (methoxymethyl) melamine.

Therefore, the coating composition also preferably contains an effective cross-linking agent. The basis for selecting the cross-linking agent is that it has temperature stability and that it is reasonably stable in the presence of corrosion resistant pigments that are added to the composition.

The amount of cross-linking agent is directly proportional to the number of carboxylic groups present in the isocyanate copolymer. The temperature required for a complete cure of the isocyanate/melamine mixture is about 300° F. to about 500° F. for a period ranging from about 10 minutes at the lower temperature to about 1 minute at the higher.

In order to achieve lower cross-linking temperatures, it is desirable to add a thermosetting catalyst to the isocyanate coating composition. Preferred catalysts are Friedel-Krafts acid catalysts, boron trifluoride or a titanate complex comprising pyrophosphate titanate or phosphite titanate.

The use of the phosphite titanate markedly improves the chemical resistance of the isocyanate coating composition. The method for accelerating the cure using a titanate is:

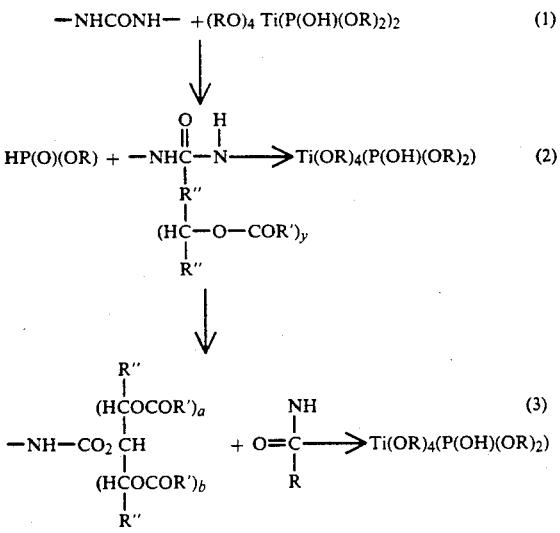

by coordinated nitrogen ligand exchange for either nitrogen or phosphorous ligands. In the above formulation, R is an alkyl group having from 3 to 12 carbon atoms, R' is an unsaturated or polysaturated ligand of about 2 to about 17 carbon atoms, and R'' is a hydrogen or an alkyl group of about from 1 to 8 carbon atoms, $2 \geqq Y \geqq 6$, and $a+b=Y-1$.

The titanate is quaternized with an amine such as 2-amino-2-methyl-1-propanol so as to become water miscible. Alternatively, the titanate is emulsified using a suitable emulsifier, i.e. sodium dodecylbenzenesulfonate (anionic), cetyl trimethyl ammonium bromide (cationic) or an ethoxylated nonyl phenol (non-ionic). The amount of titanate to be added ranges from about 0.1% to about 8.0% by weight, based on resin solids.

Preferred Friedel-Kraft acid catalysts are added in an amount ranging from about 1% to about 10% by weight based on the resin solids. Suitable acid catalysts are para toluene sulfonic acid, n-butyl acid phosphate, dodecyl succinic acid, phosphoric acid and various acid salts, such as sodium acid phosphate, sodium bisulfate and the like.

To prevent premature gelation or other instability, it is necessary to react the acid with a stoichiometric quantity of secondary or tertiary amine. This renders the acid water soluble and prevents the premature reaction with the isocyanate component.

It has also been found desirable to add a free radical inhibitor to minimize hydrolysis or other reactions that promote the instability of the resin coating composition. These inhibitors are added in amounts of about 1% to about 10% by weight based on the total solid weight of the coating composition. Suitable inhibitors are hydroquinone, guaiacol, methyl-p-amino benzoate, propyl gallate and the like.

In addition, the coating composition may contain various corrosion inhibitive pigments which impart substantially improved corrosion resistance to the coated surface. These pigments are either water soluble or they are water insoluble. Metallic salts of the Group VI-B of the periodic table are preferred corrosion inhibitors.

Suitable corrosion inhibitors are chromates such as zinc chromate, potassium chromate, potassium dichromate, sodium chromate, sodium dichromate, calcium chromate, ammonium chromate and ammonium bichromate; tungstates such as sodium tungstate, potassium tungstate, and ammonium tungstate; molybdates, such as sodium molybdate, potassium molybdate and ammonium molybdate. In addition, complex compounds of chromium, molybdenum and tungsten are acceptable as well as titanium, including lead silica chromate, amine salts of tungstic and molybdic acid and phosphite or phosphate titanium chelates as described hereinabove.

A preferred formulation is one comprised as follows:

| Formulation A | |
|---|---|
| Aliphatic, water dispersion of polyurethane | 2.25 Parts by weight |
| Strontium chromate | 2.5 Parts by weight |
| Propyl gallate | .002 Parts by weight |
| Water | 5.248 Parts by weight |

| Formulation B | |
|---|---|
| Colloidal water dispersion of polyurethane | 1.25 Parts by weight |
| Zinc chromate | 2.0 Parts by weight |
| Hexa (methoxymethyl) melamine | 1.0 Parts by weight |
| Guaiacol | .1 Parts by weight |

-continued

| Formulation B | |
|---|---|
| Para toluene sulfonic acid* | .24 Parts by weight |
| Water | 5.41 Parts by weight |

*para toluene sulfonic acid and all Friedel-Krafts acid catalysts are neutralized to pH 7.5 with Diethyl amino ethanol and diluted to 25% weight solids, active acid.

| Formulation C | |
|---|---|
| Colloidal dispersion of aromatic or aliphatic polyurethane | 1.5 Parts by weight |
| Sodium dichromate | .5 Parts by weight |
| Methyl para amino benzoate | .05 Parts by weight |
| Hexa (methoxymethyl) melamine | .8 Parts by weight |
| Phosphite titanate | .05 Parts by weight |
| Water | 7.1 Parts by weight |

Note: All formulations are adjusted, after manufacture, to pH 8.0 to 8.5 with 2-amino-2-methyl-1-propanol.

| Formulation D | |
|---|---|
| Colloidal dispersion of aliphatic or aromatic polyurethane | 2.5 Parts by weight |
| Molybdic acid/Dimethyl amino ethanol complex | .5 Parts by weight |
| Hydroquinone | .05 Parts by weight |
| Water | 6.95 Parts by weight |

| Formulation E | |
|---|---|
| Colloidal dispersion of aliphatic or aromatic polyurethane | 3.5 Parts by weight |
| Phosphite titanate* | .8 Parts by weight |
| Guaiacol | .08 Parts by weight |
| Water | |

*The phosphite titanate here is used as a corrosion inhibitor, but it also causes increased self condensation of the polyurethane during drying. This results in a higher molecular weight polymer and may, to some extent, explain the apparent improved corrosion resistance.

| Formulation F | |
|---|---|
| Colloidal dispersion of aliphatic or aromatic polyurethane | 2.0 Parts by weight |
| Sodium tungstate | .5 Parts by weight |
| Phosphite titanate | .02 Parts by weight |
| Hexa (methoxymethyl) melamine | 1.0 Parts by weight |
| Guaiacol | .08 Parts by weight |
| Water | 6.4 Parts by weight |

Note: In Formulation F, the titanate is a catalyst for the HMMM.

| Formulation G | |
|---|---|
| Colloidal dispersion of aliphatic polyurethane | 2.5 Parts by weight |
| Sodium molybdate | .5 Parts by weight |
| Aziridine catalyst | .05 Parts by weight |
| Guaiacol | .1 Parts by weight |
| Water | 6.85 Parts by weight |

The aliphatic and aromatic polyurethanes described in this disclosure are commercially available from at least the following two companies: Polyvinyl Chemicals Co. located at 730 Main Street, Wilmington, Mass. 01887, and Spencer Kellogg Co., owned by Reichold Chemical Co. The aliphatic polyurethane water dispersion is available from Polyvinyl Chemicals Company designated as R-960 and from Spencer Kellogg Co. designated as Spencol L-51 through L-55. The aromatic polyurethane water dispersion of the present invention is available from Spencer Kellogg Co. designated as Spensol L-44.

It is appreciated that other ingredients may be added to the coating composition such as fillers, pigments, dye stuffs, coloring agents, leveling agents and the like. These ingredients or components may be added depending upon the use to which the coating product is to be employed.

The process of simultaneously sealing and impregnating the unsealed anodic coating on an aluminum and its alloys is carried out through the immersion of a freshly anodized aluminum substrate surface, in a process vessel containing one of the above described compositions. The bath is maintained at about 150° F. for 30 minutes to an hour. Maintaining the bath at about 150° F. is essential to the process of the present invention because it has been found that sufficient hydration occurs at this temperature and accelerated bath aging as well as skinning problems are prevented.

The anodic coating is converted from the unsealed condition to the sealed condition through hydration of the oxide. The structural characteristics of metal oxide monohydrate and metal oxide trihydrate are in accordance with the following reactions:

$$Al_2O_3 + H_2O \rightarrow 2AlO(OH) \rightarrow Al_2O_3\ H_2O \quad (4)$$

$$2AlO(OH) + 2H_2O \rightarrow Al_2O_3\ 3H_2O \quad (5)$$

Following sealing/impregnation of the anodic coating, the anodized metal may be rinsed in water, or left unrinsed, following by drying through exposure to the air, at ambient temperatures, for the purpose of curing. The cure may be affected over a period of time through self-condensation of the polyurethane resin. Although the part may be handled and stacked as soon as it is dry, this self-condensation continues thus providing a completed cure in three to seven days. Alternatively, the anodized metal is placed in a drying oven controlled at preferably 200° F. (93.33° C.) for the purpose of curing.

When melamine is added to the coating composition, the anodized metal, with rinsing if desired, is placed in a drying oven controlled at preferably 300° F. (148.88° C.) to 500° F. (260° C.) in order to cure the protective coating. This requires a cure time of about 1 to about 10 minutes, the time and temperature being inversely related. For example, at about 300° F. (148.88° C.) the cure time is approximately 10 minutes, at about 325° F. (162.77° C.) the cure time is approximately 8 minutes, at about 400° F. (204.44° C.) the cure time is approximately 5 minutes and at about 500° F. (259.99° C.) the cure time is approximately 1 minute, the time and temperature curing relationship being based on a 0.8 mil (20.32 microns) film thickness applied to clad aluminum stock. On occasion, it is desirable to allow the component to dry prior to the curing step, thereby eliminating the rinsing step after the simultaneous seal/impregnation step.

The foregoing describes a typical processing sequence which follows the conventional steps of preparing and anodizing the aluminum substrate. Such preparation for anodizing includes (a) degreasing, (b) alkaline cleaning, and (c) deoxidizing with intermediate water rinsing after each operation (a), (b) and (c). Anodizing may be accomplished using the electrolytes and process control parameters necessary to develop anodic coatings of, although not limited to, the chromic, sulfuric and modified sulfuric acid types followed by immediate water rinse. For a discussion of cleaning and finishing aluminum and aluminum alloys, see Metal Handbook, 8th Ed. (1964), Vol. 2, published by American Society for Metals, p.o. 611-634, which is hereby incorporated by reference.

EXAMPLE 1

1. The component was vapor degreased using a trichloroethylene or 1-1-1 trichloroethane material and then left in the degreaser free board area until dry.
2. The degreased component was cleaned for approximately 18 minutes in an inhibited alkaline cleaner of PH 11.8 to 13, active alkalinity of 20% to 25% by weight, concentration of approximately 5 oz. per gallon and maintained at about 150° F.
3. The component was then rinsed in ambient water (approximately 70° F. (211.11° C.) for about 90 seconds.

The component was deoxidized for approximately 8 minutes in an aluminum deoxidizer compounded from 17 to 23 oz/gal (wt.) 66° B'e sulfuric acid, 3 to 5 oz/gal (wt.) sodium dichromate, and 0.6 to 0.8 oz/gal (wt.) ammonium bifluoride maintained at room temperature (approximately 70° F. (21.11° C.-).
5. The component was then rinsed in ambient water for approximately 2 minutes.
6. The component was then anodized for approximately 30 minutes in 15% 66° Be sulfuric acid at 6 to 24 Volts (DC), 12 to 15 amps/ft.$^2$ and maintained at approximately 70° F. (21.11° C.).
7. The anodized component was rinsed in ambient water for approximately 2 minutes.
8. The component was then immersed for about one hour in the colloidal water borne organic resin coating material, "Formulation A", diluted one part water to 1 part "Formulation A", and maintained at 175°±5° F. (80°±2.8° C.).
9. Following this hath whereby the component was concurrently sealed and primed, it was air dried at ambient temperatures for 60±5 minutes.
10. Finally, the component was cured by air drying for about seven days.

EXAMPLE 2

The component to be coated was prepared following the same steps 1 through 7 as in Example 1.

8. The component was then sealed and primed by a bath for approximately 30 minutes in the resin-contained water borne composition described above in Example 1 and maintained at 200° F. ±5° F. (93.33°±2.8°).
9. Following this bath the component was air dried and cured as in steps 9 and 10 of Example 1; however, curing was effected for about one hour at a temperature of about 180°-200° F. (82.22°−93.33° C.) in this case.

I claim:

1. A protective coating process for aluminum and aluminum alloy components the process comprising the steps of:

a) anodizing the component to be coated to form an anodized component;

b) applying a coating composition comprising a colloidal, water-borne polyurethane resin to the anodized component at a temperature of approximately 150° F. for a period ranging from about 30 to 60 minutes, wherein said coating composition seals the anodized component through hydration and simultaneously primes the anodized component to provide a surface coating; and c) curing the surface coating.

2. The process according to claim 1, wherein a cross-linking agent is added during the applying step and thereafter curing the surface coating at a temperature in a range of approximately 300° F. to 500° F. for a period ranging from 10 minutes to 1 minute, the time and temperature being inversely proportional.

* * * * *